US011409209B2

(12) United States Patent
Sim et al.

(10) Patent No.: US 11,409,209 B2
(45) Date of Patent: Aug. 9, 2022

(54) STATUS DETERMINATION AND CONTROL OF TONER CARTRIDGE USING SENSOR

(71) Applicant: HEWLETT-PACKARD DEVELOPMENT COMPANY, L.P., Spring, TX (US)

(72) Inventors: Jeongsup Sim, Gyeonggi-do (KR); Sunghi Lee, Gyeonggi-do (KR); Hyojoong Kim, Gyeonggi-do (KR); Minwoo Kang, Gyeonggi-do (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/309,682

(22) PCT Filed: Mar. 27, 2020

(86) PCT No.: PCT/US2020/025170
§ 371 (c)(1),
(2) Date: Jun. 15, 2021

(87) PCT Pub. No.: WO2021/071544
PCT Pub. Date: Apr. 15, 2021

(65) Prior Publication Data

US 2022/0026828 A1 Jan. 27, 2022

(30) Foreign Application Priority Data

Oct. 10, 2019 (KR) ..... 10-2019-0125713

(51) Int. Cl.
*G03G 15/08* (2006.01)
*G03G 15/00* (2006.01)

(52) U.S. Cl.
CPC ..... *G03G 15/0848* (2013.01); *G03G 15/0867* (2013.01); *G03G 15/5012* (2013.01)

(58) Field of Classification Search
CPC ..... G03G 15/0867; G03G 15/0893; G03G 15/0872; G03G 15/0865
See application file for complete search history.

(56) References Cited

U.S. PATENT DOCUMENTS 5,331,382 A * 7/1994 Miura ..... G03G 15/0868 399/263
6,654,568 B2 11/2003 Matsuguma
7,110,684 B2 9/2006 Isobe et al.
(Continued)

FOREIGN PATENT DOCUMENTS

JP 2005062848 A 3/2005
JP 2005316034 11/2005
(Continued)

*Primary Examiner* — Jessica L Eley
(74) *Attorney, Agent, or Firm* — Trop Pruner & Hu, P.C.

(57) ABSTRACT

An example operation method of an image forming apparatus includes obtaining, from a sensor, an output signal corresponding to a degree of shrinkage of a transporting member that transports a developing agent in a toner cartridge, as the transporting member rotates, determining a state of the toner cartridge based on a characteristic of the output signal, and executing a recovery mode that increases a driving force delivered to the transporting member when determining that the state of the toner cartridge is an abnormal state in which toner is not normally supplied to a developing device.

15 Claims, 11 Drawing Sheets

(56) References Cited

U.S. PATENT DOCUMENTS

| | | | | |
|---|---|---|---|---|
| 7,149,437 | B2 | 12/2006 | Okubo | |
| 2006/0204256 | A1* | 9/2006 | Sakamoto | G03G 15/0853 399/27 |
| 2007/0177888 | A1* | 8/2007 | Ishida | G03G 15/0893 399/49 |

FOREIGN PATENT DOCUMENTS

| | | |
|---|---|---|
| JP | 2017122772 | 7/2017 |
| JP | 2018005038 | 1/2018 |
| KR | 100602606 | 7/2006 |
| KR | 1020120107853 | 10/2012 |

* cited by examiner

STATUS DETERMINATION AND CONTROL OF TONER CARTRIDGE USING SENSOR

BACKGROUND

An image forming apparatus using an electrophotographic image forming method forms a visible toner image on a photoconductor by supplying toner to an electrostatic latent image formed on the photoconductor. The image forming apparatus transfers the formed toner image to a recording medium and fuses the transferred toner image on the recording medium, thus printing an image onto the recording medium.

A toner cartridge may supply toner to a developing device in the image forming apparatus. The toner cartridge is mountable on or demountable from the image forming apparatus, and may be replaced, such as when the toner in the toner cartridge is consumed.

BRIEF DESCRIPTION OF DRAWINGS

Various examples will be described below by referring to the following figures.

DETAILED DESCRIPTION OF EXAMPLES

Figure 1:
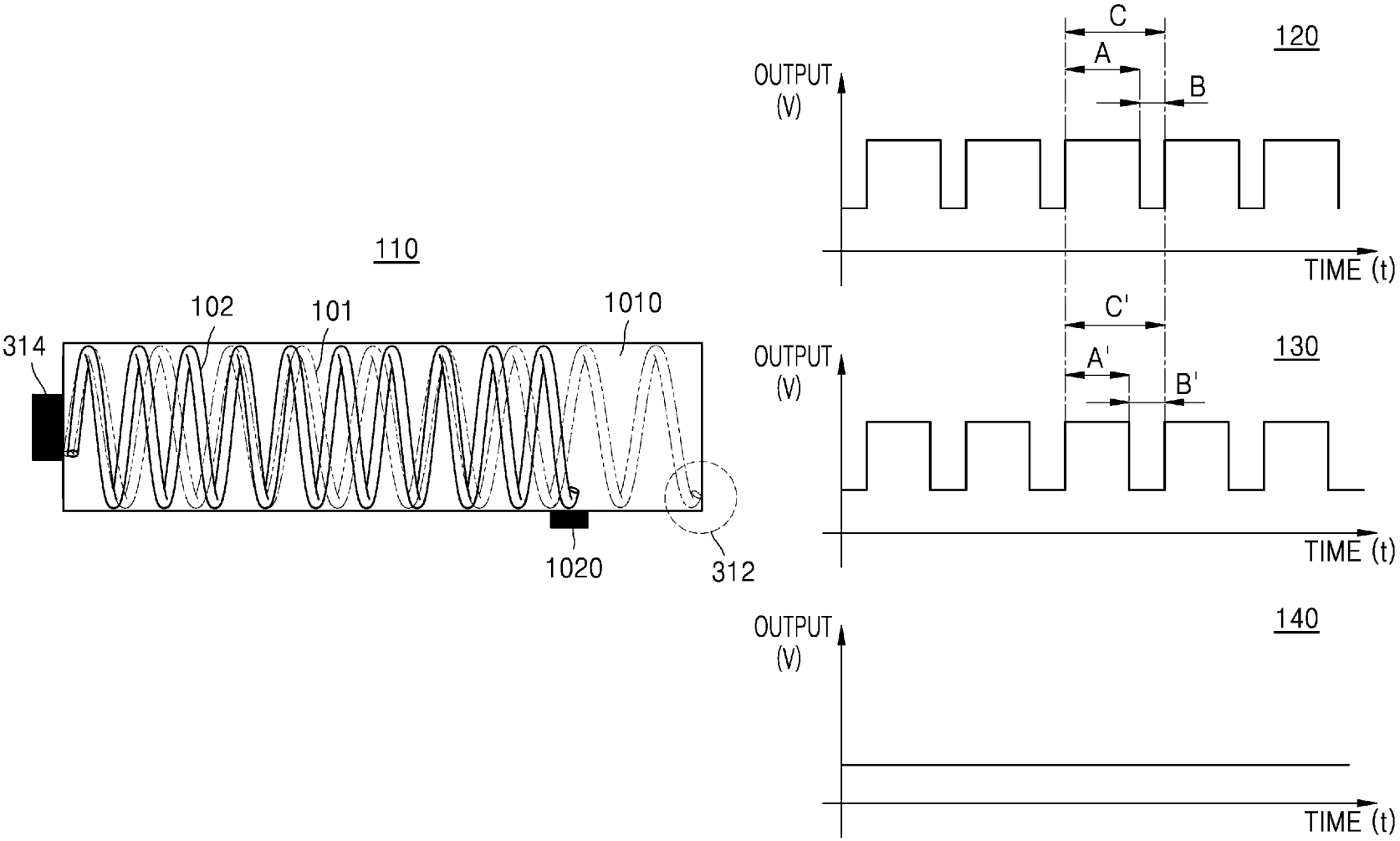
FIG. 1 is a view for describing an output signal obtained by a sensor as a transporting member in a toner cartridge shrinks, according to an example.

An "image forming apparatus" may refer to any type of apparatus capable of performing an image forming job, such as a printer, a copier, a scanner, a fax machine, a multifunction printer (MFP), a display apparatus, etc.

Hereinbelow, various examples will be described with reference to the accompanying drawings. However, the disclosure may be implemented in several different forms and is not limited to the examples described herein. Like reference numerals in the specification and the drawings denote like elements, and thus a redundant description may be omitted.

FIG. 1 is a view for describing an output signal obtained by a sensor as a transporting member in a toner cartridge shrinks, according to an example.

Referring to FIG. 1, image 110 illustrates a toner cartridge 1010 including a transporting member. As the transporting member rotates, a developing agent in the toner cartridge 1010 may be transported toward a toner outlet 312. When a distribution of the developing agent in the toner cartridge 1010 is uniform, the transporting member may remain in an original state 101 as illustrated by dashed lines in FIG. 1. However, when the distribution (e.g., density) of the developing agent in the toner cartridge 1010 increases toward the toner outlet 312 in a direction opposite to a driving coupler 314 that delivers a driving force to the transporting member 101, the transporting member may shrink (e.g., be compressed) to a shrunken state 102 toward the driving coupler 314 as illustrated by solid lines in FIG. 1. For example, a length of the transporting member may be reduced from the original state 101 to the shrunken or compressed state 102.

In FIG. 1, a graph 120, a graph 130, and a graph 140 respectively show an output signal corresponding to a different degree of shrinkage of the transporting member as the transporting member rotates. For instance, the graph 120 illustrates an output signal obtained by a sensor 1020 when the transporting member remains in the original state 101 without shrinking. In the output signal of the graph 120, C indicates a time period of one rotation by the transporting member, A indicates a time in which the transporting member is not detected by the sensor 1020 within one rotation, and B indicates a time in which the transporting member is detected by the sensor 1020 within one rotation.

The graph 130 illustrates an output signal obtained by the sensor 1020 when the transporting member shrinks. In the output signal of the graph 130, C' indicates a time period of one rotation by the transporting member and may be equal to C in the output signal of the graph 120. In the output signal of the graph 130, A' indicates a time in which the transporting member is not detected by the sensor 1020 within one rotation, and B' indicates a time in which the transporting member is detected by the sensor 1020 within one rotation. As the transporting member shrinks, a size of region of A' may decrease and a size of region of B' may increase. The image forming apparatus may determine a status of the toner cartridge 1010 based on at least one of a relationship between a region of A and a region of A' or a relationship between a region of B and a region of B'.

The graph 140 illustrates a signal obtained by the sensor 1020 when the transporting member shrinks to a size such that it cannot be detected by the sensor 1020 or the transporting member is not coupled to a driving device (e.g., the driving coupler 314). A density change of a metal component may not be sensed by the sensor 1020 such that a value output by the sensor 1020 may be constant or an amplitude value may be small.

The image forming apparatus may determine a state of the toner cartridge 1010 corresponding to the output signal shown in the graph 130 or the graph 140 as an abnormal state and perform an operation for recovering a normal state from the abnormal state.

Figure 2:
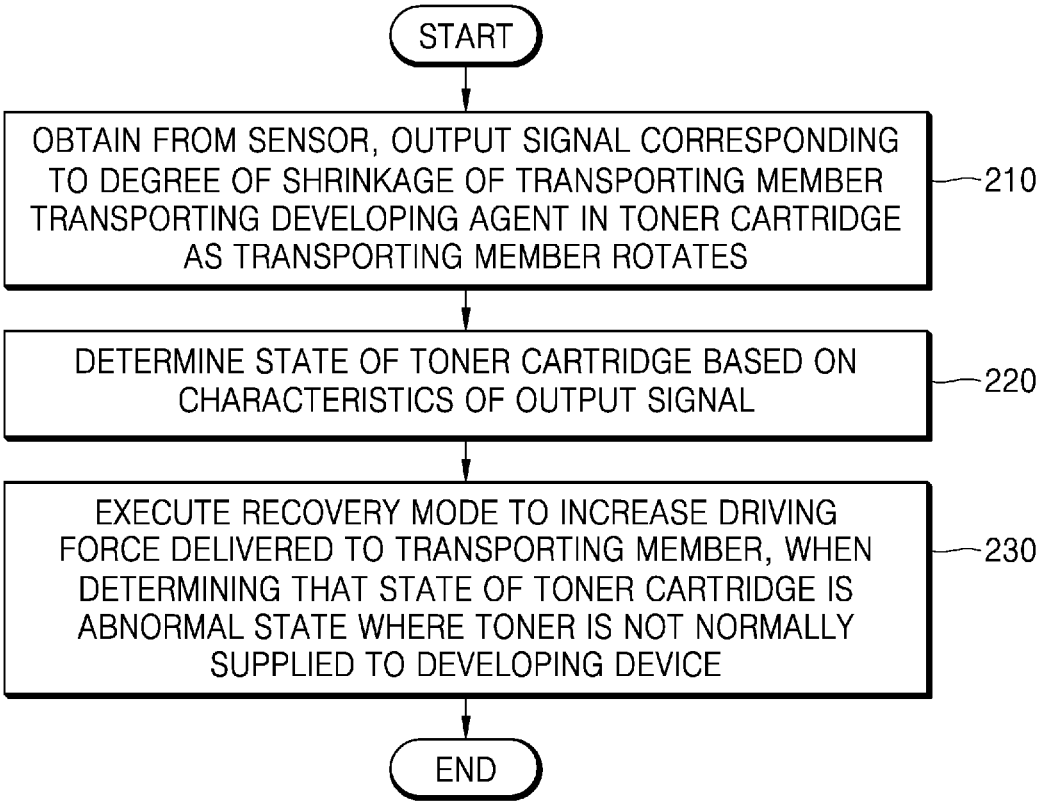
FIG. 2 is a flowchart of an operation method of an image forming apparatus, according to an example.

FIG. 2 is a flowchart of an operation method of an image forming apparatus, according to an example.

Referring to FIG. 2, as a transporting member in the toner cartridge 1010 rotates, the image forming apparatus may obtain an output signal corresponding to a degree of shrinkage of the transporting member through the sensor 1020 in operation 210. Herein, the transporting member may transfer a developing agent in the toner cartridge 1010. The developing agent may include toner and a carrier.

For example, the developing agent may include a large amount of toner and a small amount of carrier. The transporting member that transports the developing agent may be a rotator (e.g., a coil, an auger, etc.) or may include a metal component. The sensor 1020 may be an inductance-variable sensor capable of sensing a small amount of metal component. The sensor 1020 may sense a density change of a metal component as the carrier or the transporting member passes in a specific volume.

When the toner cartridge 1010 is mounted in the image forming apparatus, the sensor 1020 may be arranged near the toner outlet in the toner cartridge 1010. The sensor 1020 may obtain an output signal in which a density change of a metal component corresponding to rotation of the transporting member is sensed, in a specific range. The sensor 1020 may provide the obtained output signal to a processor of the image forming apparatus.

In operation 220, the image forming apparatus may determine the state of the toner cartridge 1010 based on a characteristic of the output signal. For example, the characteristic of the output signal may include at least one of a periodicity of the output signal or a sensing signal sensed by a sensor when a transporting member passes within a range sensible by the sensor.

For example, the image forming apparatus may determine the state of the toner cartridge 1010 based on whether the periodicity of the output signal is detected from the output signal.

As an example, when an amplitude indicating a difference between a maximum value and a minimum value in a specific period of the output signal is less than a reference amplitude, the image forming apparatus may determine that the periodicity of the output signal is absent and determine the state of the toner cartridge 1010 as the abnormal state. An example process of determining the state of the toner cartridge 1010 based on the periodicity of the output signal will be described with reference to FIGS. 5 and 6.

For example, the image forming apparatus may determine the state of the toner cartridge 1010 based on a result of comparing a sensing signal in the output signal with a reference sensing signal in a reference output signal. Herein, the sensing signal is a signal sensed by the sensor 1020 as the transporting member rotates. The reference output signal is a signal obtained by the sensor 1020 when the toner cartridge 1010 is in the normal state. The reference sensing signal is a signal sensed by the sensor 1020 as the transporting member rotates, when the toner cartridge 1010 is in the normal state. For example, the normal state of the toner cartridge 1010 may refer to a state in which the toner cartridge 1010 may normally supply toner to a developing device.

As an example, the image forming apparatus may obtain the number of sensing signals in an output signal and the number of reference sensing signals in a reference output signal, in which the sensing signals and the reference sensing signals are sampled at specific intervals. When a difference between the number of sensing signals and the number of reference sensing signals falls beyond a preset error range, the image forming apparatus may determine the state of the toner cartridge 1010 as the abnormal state. An example process of determining the state of the toner cartridge 1010 based on a sensing signal sensed by the sensor 1020 will be described with reference to FIGS. 5 and 6.

In operation 230, when the image forming apparatus determines that the state of the toner cartridge 1010 is the abnormal state in which the toner cartridge 1010 may not be able to normally supply the toner to the developing device 1030, the image forming apparatus may execute a recovery mode to increase a driving force delivered to the transporting member.

Figure 3A:
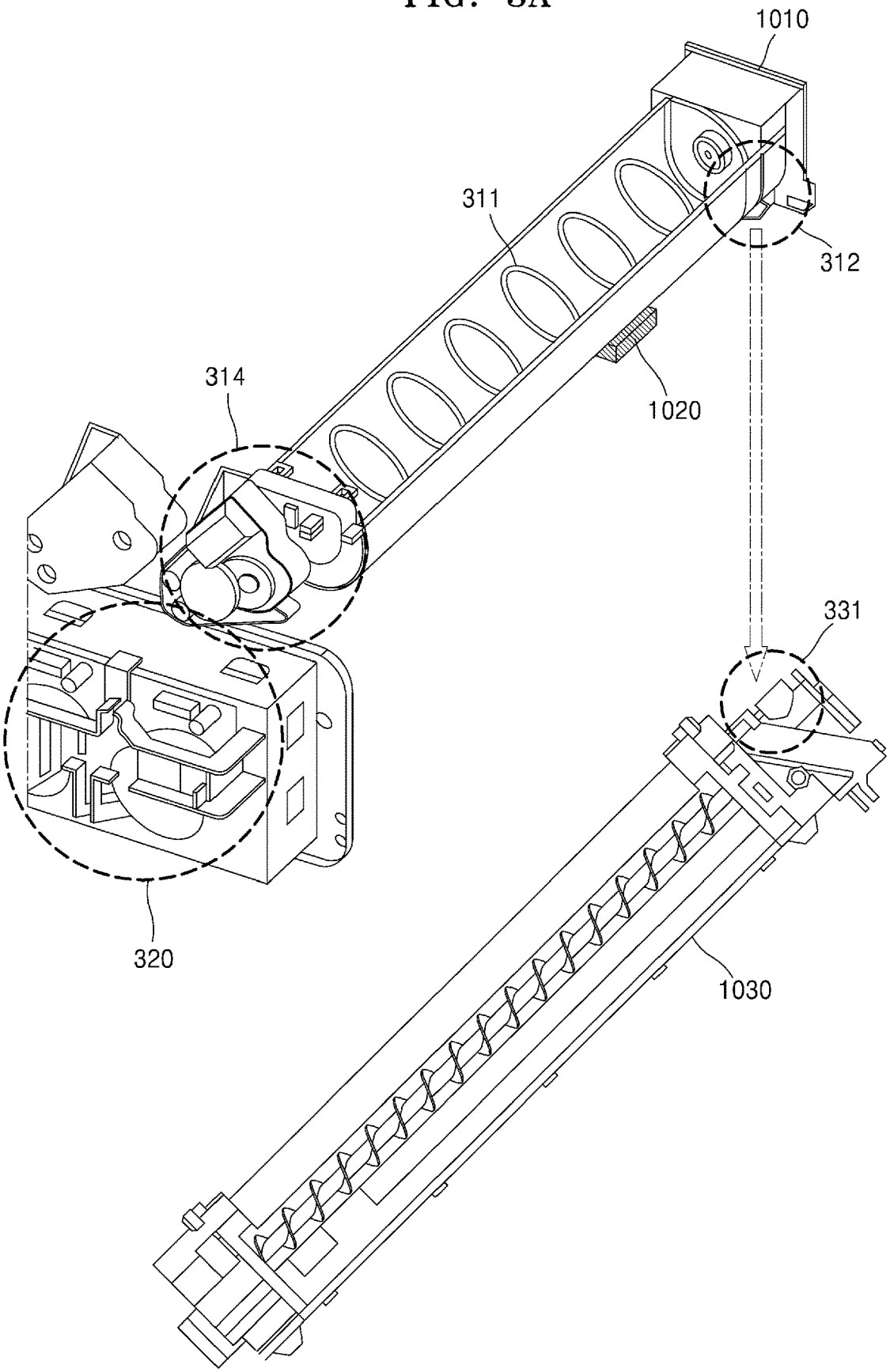
FIG. 3A is a view for describing a toner cartridge and a developing device, according to an example.

FIG. 3A is a view for describing a toner cartridge and a developing device, according to an example.

Referring to FIG. 3A, the toner cartridge 1010 may supply toner to a developing device 1030 in the image forming apparatus. As an example, as a transporting member 311 in the toner cartridge 1010 rotates, the developing agent in the toner cartridge 1010 may be transported toward the toner outlet 312. That is, as the transporting member 311 rotates, the toner in the developing agent may be discharged through the toner outlet 312 and may be injected through a toner loading hole 331 of the developing device 1030.

As shown in FIG. 3A, the transporting member 311 may have a spiral form. The image forming apparatus may deliver a driving force to the driving coupler 314 from a driving device 320 and rotate the transporting member 311 using the driving force delivered to the driving coupler 314. As the transporting member 311 rotates, the developing agent may be transported toward the toner outlet 312.

The sensor 1020 may be arranged near the toner outlet 312 in the toner cartridge 1010. The sensor 1020 may be arranged outside the toner cartridge 1010. The sensor 1020 may obtain an output signal in which a density change of a metal component corresponding to rotation of the transporting member 311 is sensed, in a specific range.

Figure 3B:
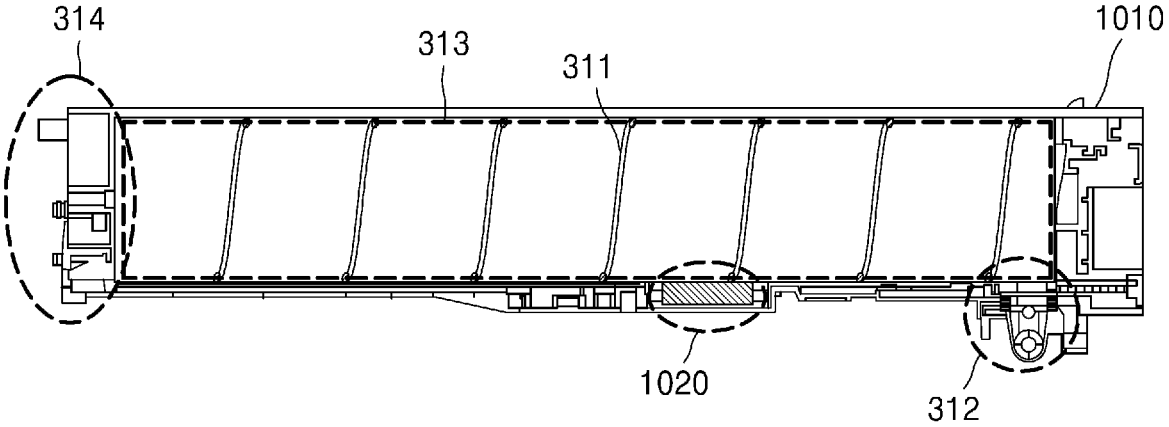
FIG. 3B is a view for describing a structure of a toner cartridge and a sensor, according to an example.

FIG. 3B is a view for describing a structure of a toner cartridge and a sensor, according to an example.

Referring to FIG. 3B, the toner cartridge 1010 may include the transporting member 311, the toner outlet 312, a toner storage 313, and the driving coupler 314. However, the shown components are not essential components. The toner cartridge 1010 may be implemented to include more components than the shown components or fewer components than the shown components.

The transporting member 311 may transfer a developing agent stored in the toner cartridge 1010. For example, as the transporting member 311 rotates, the transporting member 311 may transfer the developing agent toward the toner outlet 312. The toner storage 313 may accommodate a developing agent including a large amount of toner and a small amount of carrier. The driving coupler 314 may receive the driving force from the driving device 320 in the image forming apparatus and rotate the transporting member 311 using the received driving force.

The sensor 1020 may be arranged near the toner outlet 312 in the toner cartridge 1010. The sensor 1020 may be an inductance-variable sensor capable of sensing a small amount of a metal component. Thus, the sensor 1020 may sense a density change of a carrier in a specific volume. Each time the transporting member 311 including a metal component passes the sensor 1020 by rotating, the sensor 1020 may sense movement of the transporting member 311. That is, the sensor 1020 may obtain an output signal in which a density change of a metal component corresponding to rotation of the transporting member 311 is sensed. The sensor 1020 may calculate a residual amount of the toner remaining in the toner cartridge 1010, based on the sensed density change of the carrier within a range sensible by the sensor 1020.

Figure 4:
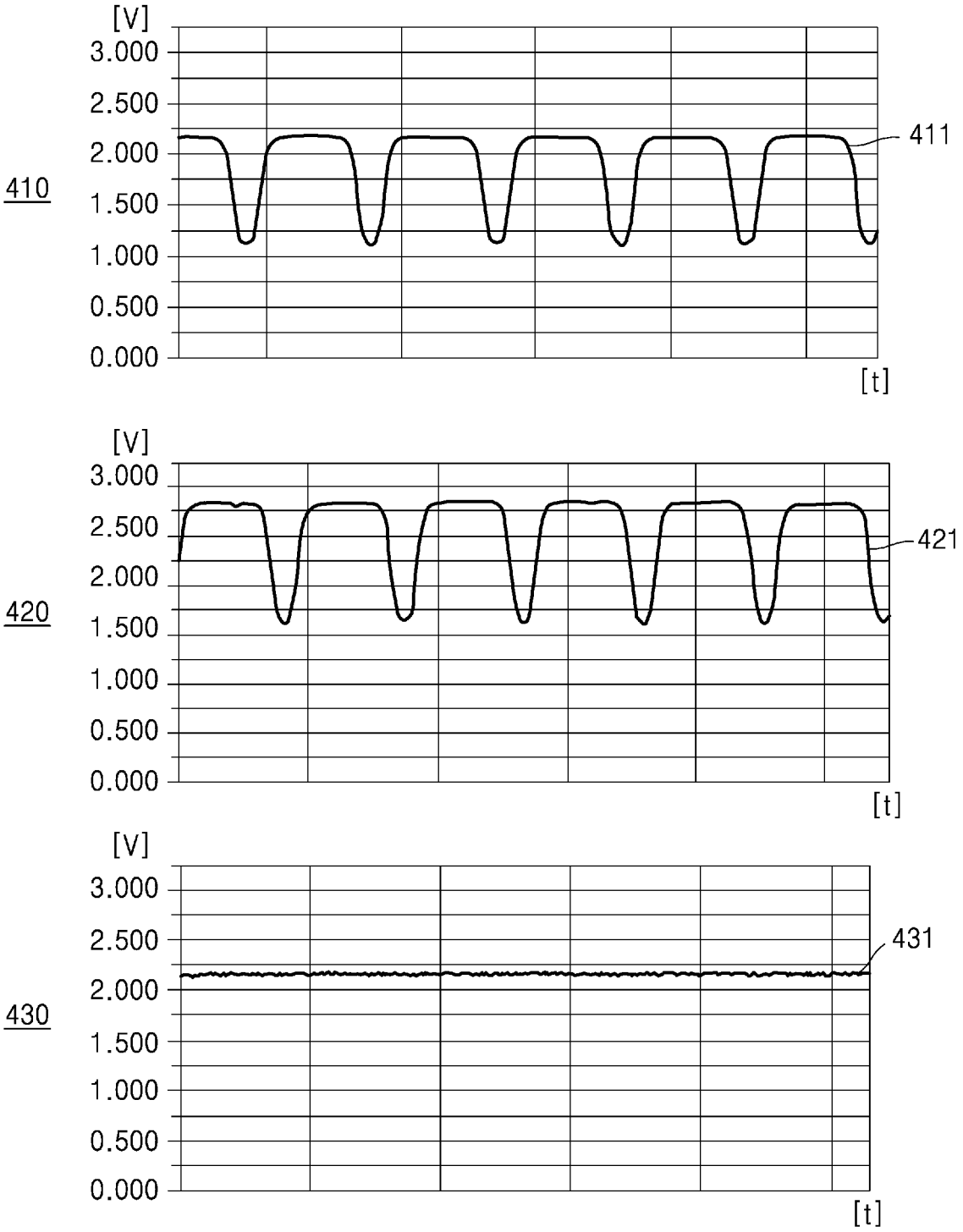
FIG. 4 is a view for describing an output signal obtained by an operation of a toner cartridge, according to an example.

FIG. 4 is a view for describing an output signal obtained by an operation of a toner cartridge, according to an example.

Referring to FIG. 4, a graph 410 shows an output signal 411 obtained from the sensor 1020 as the transporting member 311 rotates. When a rotation period of the transporting member 311 is constant, the output signal 411 may have a period that is the same as a rotation period of the transporting member 311. As there is more carrier around the sensor 1020, a maximum value of the output signal 411 may increase. Thus, a minimum value of the output signal 411 may be shown when the transporting member 311 passes around the sensor 1020. The output signal 411 may have a square wave or a form that is similar to a square wave.

In FIG. 4, a graph 420 shows an output signal 421 obtained from the sensor 1020 as a density of carrier around the sensor 1020 increases. Within the range sensible by the sensor 1020, an output value corresponding to a high carrier density may be higher than an output value corresponding to a low carrier density. Thus, a maximum value and a minimum value of the output signal 421 shown in the graph 420 of FIG. 4 may be higher than a maximum value and a minimum value of the output signal 411 shown in the graph 410 of FIG. 4.

In FIG. 4, a graph 430 shows an output signal 431 obtained from the sensor 1020 when the transporting member 311 does not rotate. When the transporting member 311 does not rotate, there is no density change of the metal component within the range sensible by the sensor 1020. Thus, a value of the output signal 431 obtained by the sensor 1020 may be constant. An output value of the output signal 431 shown in the graph 430 of FIG. 4 may be equal to or similar to a maximum value of the output signal 411 shown in the graph 410 of FIG. 4. An output value of the output signal 431 shown in the graph 430 may change with a position of the transporting member 311, and with a control voltage input to the sensor 1020.

Figure 5:
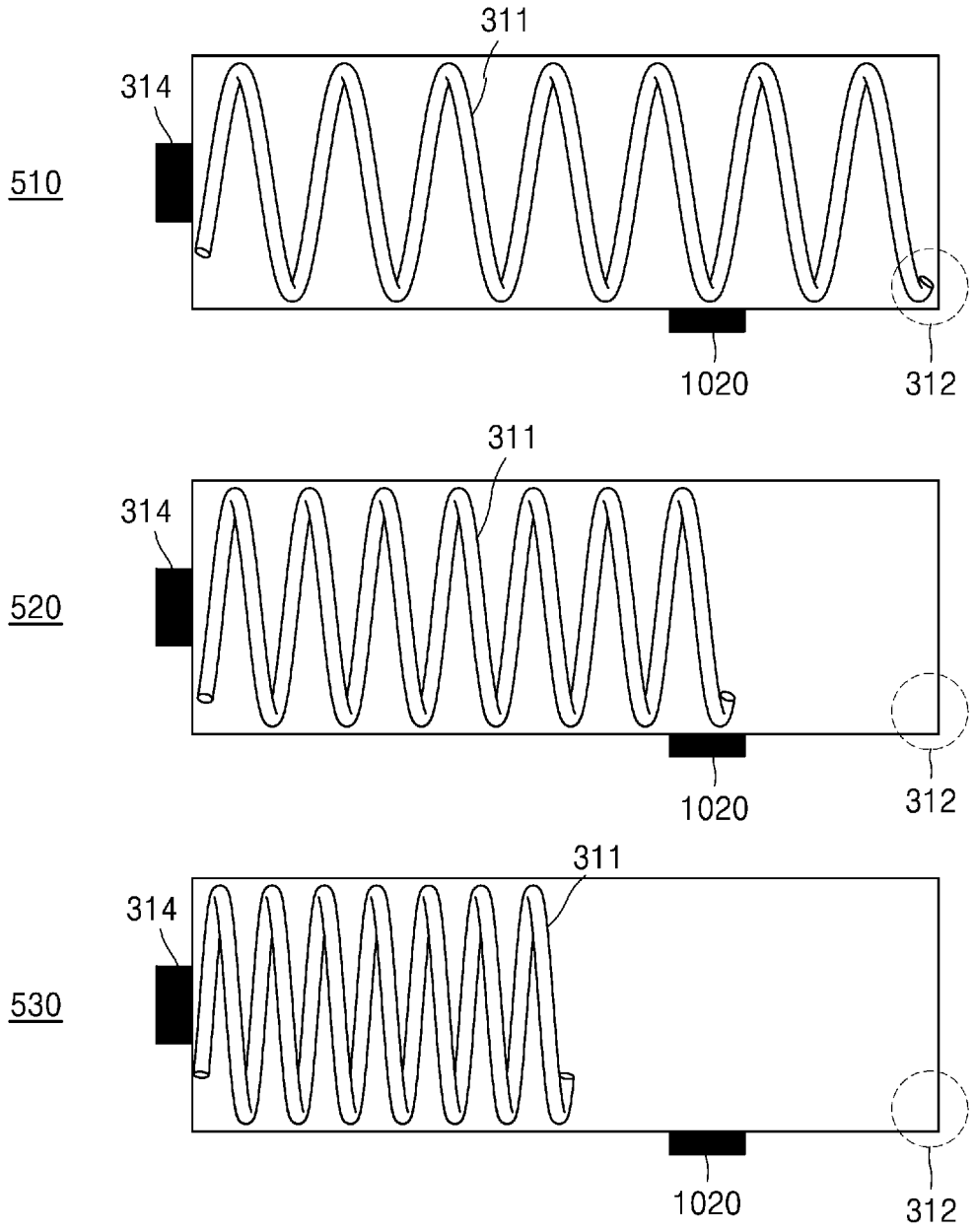
FIG. 5 is a view for describing an exterior status of a transporting member with respect to a distribution of a developing agent in a toner cartridge, according to an example.
Figure 6:
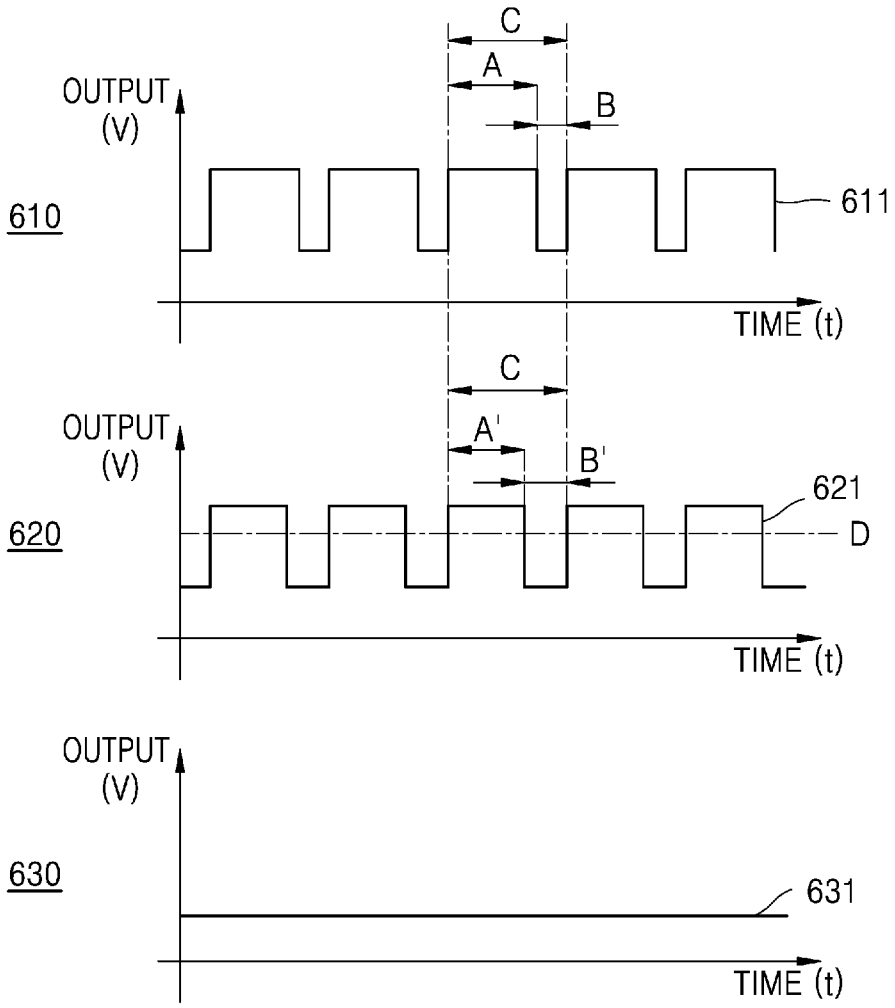
FIG. 6 is a view for describing an output waveform obtained when a toner cartridge is in a normal state and when the toner cartridge is in an abnormal state, according to an example.

FIG. 5 is a view for describing an exterior status of a transporting member with respect to a distribution of a developing agent in a toner cartridge, according to an example. FIG. 6 is a view for describing an output waveform obtained when a toner cartridge is in a normal state and when the toner cartridge is in an abnormal state, according to an example.

Referring to FIG. 5, image 510 shows an exterior state of the transporting member 311 when the state of the toner cartridge 1010 is the normal state. As the transporting member 311 rotates, the transporting member 311 may transfer the developing agent toward the toner outlet 312.

Referring to FIG. 6, a graph 610 shows an output signal 611 obtained from the sensor 1020 when the state of the toner cartridge 1010 is the normal state.

An image 520 of FIG. 5 shows an exterior state of the transporting member 311 when the state of the toner cartridge 1010 is the abnormal state. When the density of the developing agent in the toner cartridge 1010 is higher toward the toner outlet 312, the transporting member 311 may shrink toward the driving coupler 314. As can be seen from the image 520 of FIG. 5, when the transporting member 311 rotates in a state of shrinking toward the driving coupler 314, the toner may not be normally transferred toward the toner outlet 312 and thus may not be normally supplied to the developing device 1030. For example, a graph 620 of FIG. 6 shows an output signal 621 obtained from the sensor 1020 when the state of the toner cartridge 1010 is the abnormal state. In this case, the output signal 621 obtained by the sensor 1020 becomes different from the output signal 611 obtained in the normal state of the toner cartridge 1010.

An image 530 of FIG. 5 shows an exterior state of the transporting member 311 when the state of the toner cartridge 1010 is the abnormal state. When the density of the developing agent in the toner cartridge 1010 becomes higher toward the toner outlet 312, the transporting member 311 may further shrink toward the driving coupler 314. For example, in spite of rotation of the transporting member 311, the sensor 1020 may not sense a carrier or the transporting member 311 and may obtain an output signal 631 shown in a graph 630 of FIG. 6.

For example, the graph 610 of FIG. 6 shows the output signal 611 obtained from the sensor 1020 when the state of the toner cartridge 1010 is the normal state. That is, as the transporting member 311 in the toner cartridge 1010 rotates, the sensor 1020 may obtain an output signal having periodicity as shown in the graph 610.

In the output signal 611, C indicates a period of one rotation of the transporting member 311, A indicates a time in which the transporting member 311 is not detected by the sensor 1020 within one rotation, and B indicates a time in which the transporting member 311 is detected by the sensor 1020 within one rotation. Herein, A and B may change with a sensing direction of the sensor 1020, a characteristic of a material, or a range sensible by the sensor 1020. Also, C may change with revolutions per minute (RPM) of the driving device.

When the density of the toner in the toner cartridge 1010 increases in a direction opposite to the toner outlet 312, the toner may not be normally supplied to the developing device 1030 due to imbalance of the distribution of the toner in the toner cartridge 1010. In this case, the transporting member 311 may shrink and thus an exterior state thereof may change.

For example, the graph 620 of FIG. 6 shows the output signal 621 obtained from the sensor 1020 when the state of the toner cartridge 1010 is the abnormal state. In the output signal 621, C indicates a period of one rotation of the transporting member 311 and may be the same as C in the output signal 611. In the output signal 621, A' indicates a time in which the transporting member 311 is not detected by the sensor 1020 within one rotation and B' indicates a time in which the transporting member 311 is detected by the sensor 1020 within one rotation. As the transporting member shrinks, a region of A' may decrease and a region of B' may increase.

For example, the graph 630 of FIG. 6 shows the output signal 631 obtained from the sensor 1020 when the state of the toner cartridge 1010 is the abnormal state. For example, when the transporting member 311 shrinks to a size such that it cannot be sensed by the sensor 1020 or the transporting member 311 leaves (e.g., is displaced from) the driving device 320, the sensor 1020 may not sense a density change of a metal component, such that a value output from the sensor 1020 may be constant. In this case, the output signal 631 may not have a periodicity and may have a small amplitude value. Thus, an amplitude value may be a parameter used for detecting the abnormal state of the toner cartridge 1010 corresponding to the output signal 631 shown in the graph 630.

For example, to determine the abnormal state of the toner cartridge 1010 corresponding to the output signal 631 shown in the graph 630, the image forming apparatus may perform a process of determining an absence of periodicity of an output signal when an amplitude indicating a difference between a maximum value and a minimum value in a period of the output signal is less than a reference amplitude and determining that the state of the toner cartridge 1010 is the abnormal state.

As an example, an amplitude of an output signal may be calculated by Equation 1, and whether an output signal has periodicity may be determined by Equation 2.

$$V_{amplitude}=\text{Maximum value}-\text{Minimum value for one period} \quad \text{Equation 1}$$

A reference amplitude may be a threshold amplitude, obtained corresponding to rotation of the transporting member 311 in the normal state of the toner cartridge 1010, to determine whether the output signal has periodicity. For example, the reference amplitude may be set to 0.3 V.

$$V_{amplitude}<V_{limit}(V_{limit}\text{ indicates a reference amplitude}) \quad \text{Equation 2}$$

Thus, when a condition of Equation (2) is satisfied, the image forming apparatus may determine that the output signal does not have periodicity and determine that the state of the toner cartridge 1010 is the abnormal state.

For example, when the state of the toner cartridge 1010 is determined as the abnormal state, based on Equation (2), the image forming apparatus may determine that the distribution of the developing agent in the toner cartridge 1010 is not uniform and execute a recovery mode for spreading the developing agent in a region having a high density of the developing agent in a specific direction. The image forming apparatus may rotate the transporting member 311 while increasing a driving force delivered to the transporting member 311 by increasing a current or RPM of the driving device. For example, the image forming apparatus may rotate the transporting member 311 twice while increasing a driving force delivered to the transporting member 311. Upon execution of the recovery mode, the density of the developing agent in the region having a high density of the developing agent may be reduced and the overall density may be more evenly distributed.

The recovery mode may be executed for the toner cartridge 1010 and the image forming apparatus may determine whether the toner cartridge 1010 is recovered to the normal state.

For example, the image forming apparatus may determine whether an output signal is a signal in the abnormal state of the toner cartridge 1010 or a signal in the normal state of the toner cartridge 1010, by comparing the output signal with a reference output signal obtained in the normal state of the toner cartridge 1010.

Referring to the graph 610 of FIG. 6, when sampling is performed in every period t in the output signal 611 in the normal state of the toner cartridge 1010, the number of values of A in one period, measured in every period t, may be indicated by N_A, the number of values of B in one period, measured in every period t, may be indicated by N_B, and the number of values of C in one period, measured in every period t, may be indicated by N_C.

According to an example operation of the toner cartridge 1010, when a voltage value $V_{out}$ measured for an output signal by the sensor 1020 in every period is n, by accumulating n N_C times, a sum of all values measured in one period may be obtained. For example, referring to the graph 620 of FIG. 6, by accumulating the voltage value $V_{out}$, n, N_C times for the output signal 621, a sum of voltage values measured in one period may be obtained. A sum of voltage values may be expressed as Sum_C and may be calculated using Equation (3). An average value D of voltage values measured in one period may be calculated using Equation (4).

$$\text{Sum_}C=\Sigma_{k=0}^{N_C}n_k(k\text{ is an integer}) \quad \text{Equation 3}$$

$$D=\text{Sum_}C/N_C \quad \text{Equation 4}$$

For example, referring to the graph 620 of FIG. 6, when a sampled voltage value n is greater than the average value D, the image forming apparatus may indicate it as A', and when the sampled voltage value n is less than the average voltage D, the image forming apparatus may indicate it as B'. In the output signal 621, A' indicates a time in which the transporting member 311 is not detected by the sensor 1020 within one rotation and B' indicates a time in which the transporting member 311 is detected by the sensor 1020 within one rotation. As the transporting member shrinks, a region of A' may decrease and a region of B' may increase. Even when the output signal 621 has periodicity, the image forming apparatus may determine, based on a condition, whether toner may be normally supplied to the developing device 1030 from the toner cartridge 1010 according to rotation of the transporting member 311. That is, the image forming apparatus may determine, based on a specific condition, whether the state of the toner cartridge 1010 is the normal state. For example, when a difference between the number of sensing signals, sampled at specific intervals, by the transporting member 311 in an output signal, and the number of reference sensing signals, sampled at the specific intervals, by the transporting member 311 in a reference output signal falls beyond a preset error range, the image forming apparatus may determine the state of the toner cartridge 1010 as the abnormal state.

As an example, the number of values sampled in periods t as A' and B' in one period of an output signal may be indicated by R_A' and R_B'. When a difference between R_A' and R_B' and N_A and N_B corresponding to the normal state of the toner cartridge 1010 falls within a specific error range, the image forming apparatus may determine that the state of the toner cartridge 1010 is the normal state. For example, a specific error range may be ±10%. When the specific error range is ±10%, the image forming apparatus may determine that the state of the toner cartridge 1010 is the normal state when a relationship between R_A' and N_A and a relationship between R_B' and N_B satisfy conditions of Equation (5) and Equation (6). After execution of the recovery mode, when the relationship between R_A' and N_A and the relationship between R_B' and N_B satisfy the conditions of Equation (5) and Equation (6), the image forming apparatus may determine that the state of the toner cartridge 1010 is recovered to the normal state.

$$0.9\times N_A<R_A'<1.1\times N_A \quad \text{Equation 5}$$

$$0.9\times N_B<R_B'<1.1\times N_B \quad \text{Equation 6}$$

On the other hand, the image forming apparatus may determine that the state of the toner cartridge 1010 is the abnormal state when the relationship between R_A' and N_A and the relationship between R_B' and N_B fail to satisfy the conditions of Equation (5) and Equation (6). However, even when the conditions of Equation (5) and Equation (6) fail to be satisfied, the image forming apparatus may perform an image forming job, such that a manager may set a condition that is relaxed compared to a condition of the normal state to allow the image forming apparatus to perform an operation corresponding to the set relaxed condition of the normal state. For example, the relaxed condition of the normal state may be expressed by Equation (7).

$$0.7 \times N_A < R_A' \quad \text{Equation 7}$$

For example, the image forming apparatus may determine that the state of the toner cartridge 1010 is the abnormal state when the relationship between R_A' and N_A fails to satisfy a condition of Equation (7).

The relaxed condition of the normal state may include a condition in which the number of accumulated times the recovery mode is executed exceeds a specific number of times. For example, when the number of accumulated times the recovery mode is executed exceeds three and the condition of Equation (7) is satisfied, the image forming apparatus may determine that the state of the toner cartridge 1010 is the normal state. On the other hand, when the number of accumulated times the recovery mode is executed exceeds three, but the condition of Equation (7) is not satisfied, the image forming apparatus may determine that the state of the toner cartridge 1010 is the abnormal state.

Figure 7:
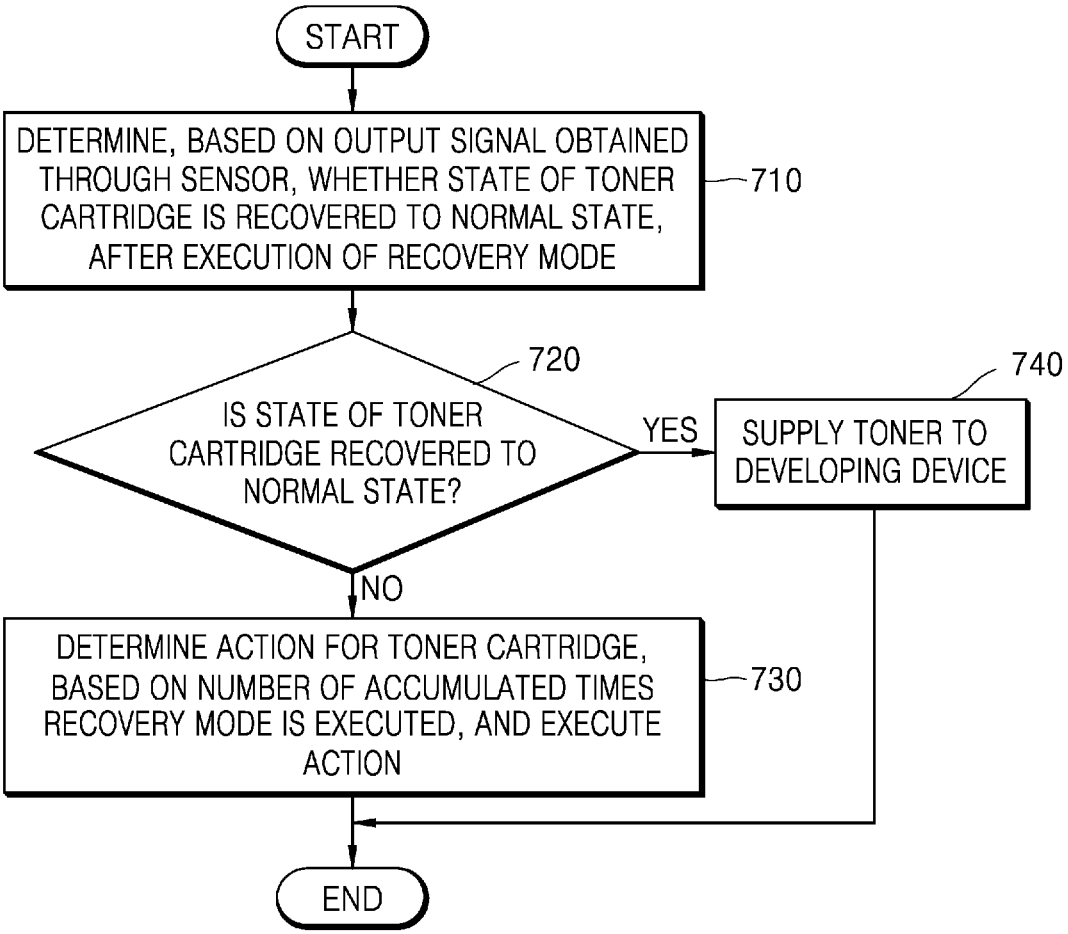
FIG. 7 is a flowchart of an operation method of an image forming apparatus after execution of a recovery mode, according to an example.

FIG. 7 is a flowchart of an operation method of an image forming apparatus after execution of a recovery mode, according to an example.

Referring to FIG. 7, after execution of the recovery mode, the image forming apparatus may determine, based on an output signal obtained through the sensor 1020, that the state of the toner cartridge 1010 is recovered to the normal state in operation 710.

The image forming apparatus may determine whether the state of the toner cartridge 1010 is recovered to the normal state according to a first process of determining the state of the toner cartridge 1010 based on Equation (1) and Equation (2).

The image forming apparatus may also determine whether the state of the toner cartridge 1010 is recovered to the normal state, according to a second process of determining the state of the toner cartridge 1010 based on Equation (5) and Equation (6).

The image forming apparatus may also determine whether the state of the toner cartridge 1010 is recovered to the normal state, according to a third process of determining the state of the toner cartridge 1010 based on Equation (7).

For example, the image forming apparatus may determine whether the state of the toner cartridge 1010 is the normal state through a combination of at least one of the first process, the second process, and the third process.

In operation 720, when the state of the toner cartridge 1010 is not recovered to the normal state, the image forming apparatus may perform operation 730. On the other hand, when the state of the toner cartridge 1010 is recovered to the normal state, the image forming apparatus may perform operation 740.

In operation 730, the image forming apparatus may determine an action for the toner cartridge 1010 based on the number of accumulated times the recovery mode is executed, and execute the determined action.

For example, when the number of accumulated times the recovery mode is executed is less than three, the image forming apparatus may re-execute the recovery mode to increase a driving force delivered to the transporting member.

For example, when the number of accumulated times the recovery mode is executed is equal to or greater than three, the image forming apparatus may determine that an action of shaking the toner cartridge 1010 is needed. The image forming apparatus may display first guide information that guides removal of the toner cartridge 1010 from the image forming apparatus and shaking of the toner cartridge 1010. A user may remove the toner cartridge 1010 from the image forming apparatus and shake the toner cartridge 1010 to mix the developing agent in the toner cartridge 1010. The user may finish shaking the toner cartridge 1010 and mount the toner cartridge 1010 on the image forming apparatus. When the toner cartridge 1010 is mounted on the image forming apparatus, the image forming apparatus may determine, based on an output signal obtained through the sensor 1020, that the state of the toner cartridge 1010 is recovered to the normal state.

For example, when the number of accumulated times the recovery mode is executed is equal to or greater than three and shaking of the toner cartridge 1010 has already been performed, the image forming apparatus may determine that the toner cartridge 1010 leaves the driving device in the image forming apparatus and needs to be replaced. The image forming apparatus may display second guide information indicating that the toner cartridge 1010 leaves the image forming apparatus and thus needs to be replaced. The user may replace the toner cartridge 1010 presently used with a new toner cartridge.

In operation 740, the image forming apparatus may determine that the state of the toner cartridge 1010 is the normal state and control operations of components of the toner cartridge 1010 to supply toner to the developing device 1030 from the toner cartridge 1010.

Figure 8:
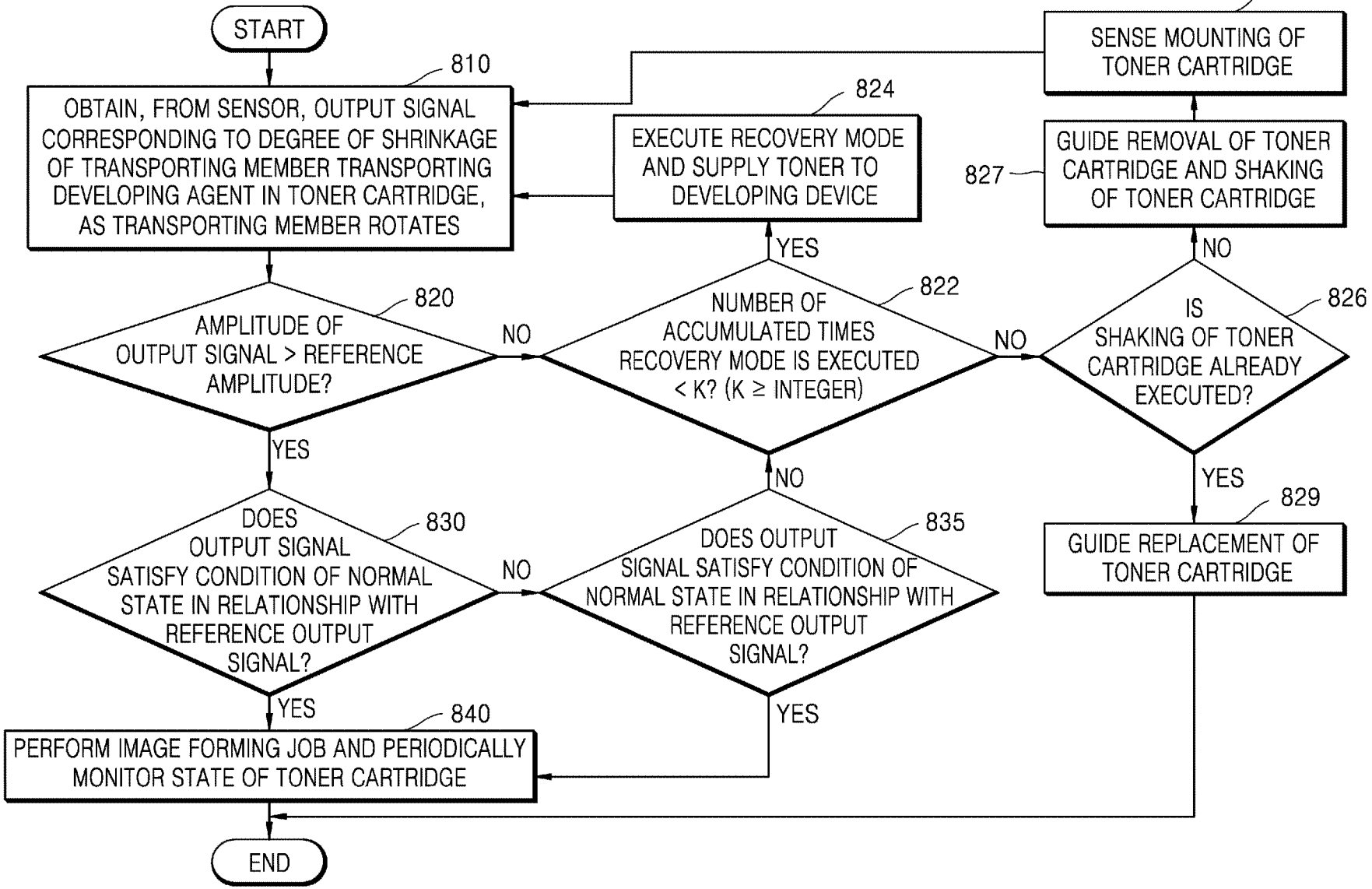
FIG. 8 is a flowchart of an operation method of an image forming apparatus, according to an example.

FIG. 8 is a flowchart of an operation method of an image forming apparatus, according to an example.

Referring to FIG. 8, as the transporting member transporting the developing agent in the toner cartridge 1010 rotates, the image forming apparatus may obtain an output signal corresponding to a degree of shrinkage of the transporting member from the sensor 1020 in operation 810. The image forming apparatus may determine the state of the toner cartridge 1010 based on a characteristic of the output signal. For example, the characteristic of the output signal may include at least one of a periodicity of the output signal or a sensing signal sensed by a sensor when a transporting member passes within a range sensible by the sensor.

In operation 820, the image forming apparatus may determine whether an amplitude indicating a difference between a maximum value and a minimum value in one period of the output signal exceeds a reference amplitude. As an example, the image forming apparatus may determine, based on Equation (1) and Equation (2), whether the amplitude exceeds the reference amplitude. When the amplitude is less than the reference amplitude, the image forming apparatus may determine that the state of the toner cartridge 1010 is the abnormal state and perform operation 822. On the other hand, when the amplitude exceeds the reference amplitude, the image forming apparatus may determine that the state of the toner cartridge 1010 is the normal state and perform operation 830.

For example, when the amplitude is less than the reference amplitude, in operation 822, the image forming apparatus may determine whether the number of accumulated times the recovery mode is executed for the toner cartridge 1010 is less than a reference number.

For example, when the number of accumulated times the recovery mode is executed is less than a reference number, the image forming apparatus may execute the recovery mode to increase a driving force delivered to the transporting member in operation 824. For example, as the recovery mode is executed, the image forming apparatus may rotate the transporting member twice while increasing a driving force delivered to the transporting member. After execution of the recovery mode, the image forming apparatus may obtain an output signal from the sensor 1020 and determine the state of the cartridge toner 1010 based on the output signal in operation 810.

For example, when the number of accumulated times the recovery mode is executed is equal to or greater than the reference number, the image forming apparatus may determine whether the action of shaking the toner cartridge 1010 is performed, in operation 826. When the image forming apparatus determines that the action of shaking the toner cartridge 1010 is not performed, the image forming apparatus 10 may display the first guide information guiding removal of the toner cartridge 1010 and shaking of the toner cartridge 1010, in operation 827. The user may remove the toner cartridge 1010 and perform shaking of the toner cartridge 1010, based on the first guide information, and mount the toner cartridge 1010 on the image forming apparatus. In operation 828, the image forming apparatus may sense mounting of the toner cartridge 1010. Thereafter, the image forming apparatus may obtain an output signal from the sensor 1020 and determine the state of the cartridge toner 1010 based on the output signal in operation 810. On the other hand, when the image forming apparatus determines that shaking of the toner cartridge 1010 has already been executed, the image forming apparatus may determine the toner cartridge 1010 leaves the driving device in the image forming apparatus and thus needs to be replaced. The image forming apparatus may display the second guide information guiding replacement of the toner cartridge 1010, in operation 829. The user may replace the toner cartridge 1010 presently used with a new toner cartridge.

For example, when the amplitude exceeds the reference amplitude, the image forming apparatus may determine whether the output signal satisfies the condition of the normal state in the relationship with the reference signal, in operation 830.

For example, when a difference between the number of sensing signals, sampled at specific intervals by the transporting member in an output signal, and the number of reference sensing signals by the transporting member in a reference output signal falls beyond a preset error range, the image forming apparatus may determine the state of the toner cartridge 1010 as the abnormal state. As an example, the image forming apparatus may determine, based on Equation (5) and Equation (6), whether an output signal satisfies the condition of the normal state in the relationship with the reference signal.

For example, when the output signal satisfies the condition of the normal state in the relationship with the reference signal, the image forming apparatus may perform an image forming job and periodically monitor the state of the toner cartridge 1010, in operation 840. On the other hand, when the output signal fails to satisfy the condition of the normal state in the relationship with the reference signal, the image forming apparatus may perform operation 835.

For example, the image forming apparatus may determine whether an output signal satisfies a relaxed condition of the normal state in the relationship with the reference signal. The image forming apparatus may set a value of a rate with respect to N_A indicating the number of values A measured in periods t, within one period of the reference output signal as a threshold value for relaxation of the normal state. For example, referring to Equation (7), when R_A' indicating the number of values A' measured in periods t within one period of the reference output signal exceeds 70% of N_A, the image forming apparatus may determine that the state of the toner cartridge 1010 is the normal state. On the other hand, when R_A' does not exceed 70% with respect to N_A, the image forming apparatus may determine that the state of the toner cartridge 1010 is the abnormal state.

When the image forming apparatus determines that the output signal fails to satisfy the relaxed condition of the normal state in the relationship with the reference signal, the image forming apparatus may perform operation 822. On the other hand, when the output signal satisfies the relaxed condition of the normal state, the image forming apparatus may perform operation 840.

Figure 9:
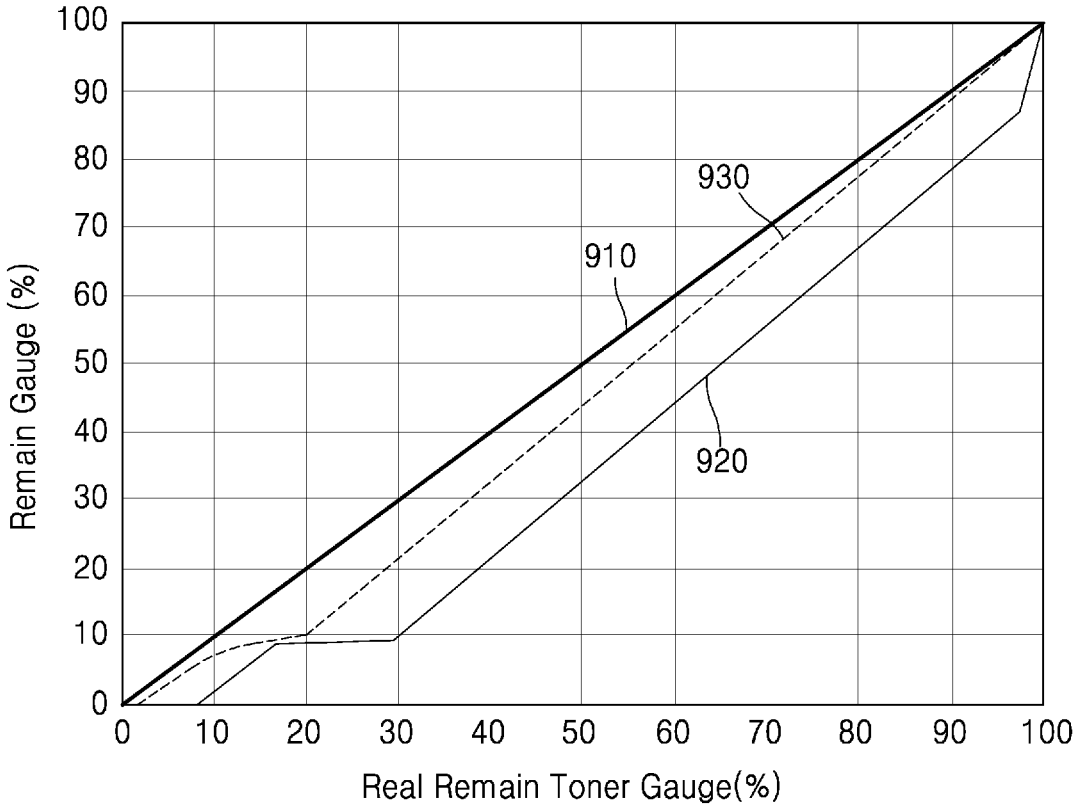
FIG. 9 is a view for describing a result of supplying toner through an operation of a toner cartridge in a recovery mode, according to an example.

FIG. 9 is a view for describing a result of supplying toner through an operation of a toner cartridge in a recovery mode, according to an example.

Referring to FIG. 9, a graph 910 may indicate an ideal toner gauge in which a real toner amount remaining in the toner cartridge 1010 is equal to a calculated toner amount, as the toner is supplied. The graph 920 may also indicate a toner gauge in which the real toner amount remaining in the toner cartridge 1010 is not equal to the calculated toner amount, when the toner is supplied in the abnormal state of the toner cartridge 1010 due to shrinkage of the transporting member in the toner cartridge 1010, etc.

The graph 930 may indicate a toner gauge in which a difference between the real toner amount remaining in the toner cartridge 1010 and the calculated toner amount is reduced, by executing the recovery mode when the image forming apparatus determines that the state of the toner cartridge 1010 is the abnormal state as the toner is supplied from the toner cartridge 1010 to the developing device 1030.

That is, by determining in advance the abnormal state of the toner cartridge 1010 based on an output signal sensing the transporting member or a carrier in the toner cartridge 1010 before abnormal supply of the toner to the developing device 1030, the image forming apparatus may prevent stress from being applied to the developing device 1030.

The image forming apparatus may also sense the abnormal state of the toner cartridge 1010 and maintain a supply of the toner constant to improve the accuracy of the remaining amount of the toner in the toner cartridge 1010, when a failure occurs in the supply of the toner due to an increasing density of the toner in the toner cartridge 1010, caused by long-term negligence of the toner cartridge 1010, etc.

When the image forming apparatus determines that the state of the toner cartridge 1010 is the abnormal state, the image forming apparatus may also execute the recovery mode for automatically recovering the normal state of the toner cartridge 1010.

Figure 10:
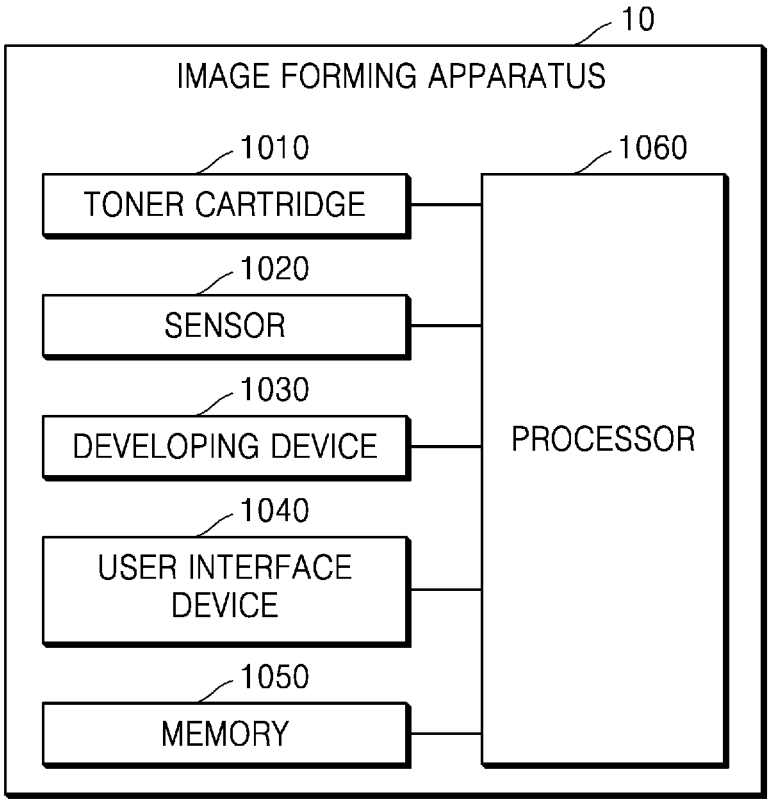
FIG. 10 is a block diagram showing a structure of an image forming apparatus, according to an example.

FIG. 10 is a block diagram showing a structure of an image forming apparatus, according to an example.

Referring to FIG. 10, an image forming apparatus 10 may include the toner cartridge 1010, the sensor 1020, the developing device 1030, a user interface device 1040, a memory 1050, and a processor 1060. However, all the shown components are not essential components. The image forming apparatus 10 may include more components than the shown components or fewer components than the shown components. Hereinafter, the components will be described.

The toner cartridge 1010 may supply toner to the developing device 1030 in the image forming apparatus 10. As an example, as the transporting member in the toner cartridge 1010 rotates, the developing agent in the toner cartridge 1010 may be transported toward the toner outlet. That is, as the transporting member rotates, the toner in the developing agent may be discharged through the toner outlet and may be injected through the toner loading hole of the developing device 1030.

As illustrated in the example of FIGS. 3A and 3B, the toner cartridge 1010 may include a transporting member (e.g., 311), a toner outlet (e.g., 312), a toner storage (e.g., 313), and a driving coupler (e.g., 314). The transporting member may transfer the developing agent stored in the toner cartridge 1010. For example, as the transporting member rotates, the transporting member may transfer the developing agent toward the toner outlet. The toner storage may accommodate a large amount of toner and a small amount of carrier. The driving coupler may receive the driving force from a driving device (e.g., 320) in the image forming apparatus 10 and rotate the transporting member using the received driving force.

The sensor 1020 may be arranged near the toner outlet in the toner cartridge 1010. The sensor 1020 may be an inductance-variable sensor capable of sensing a small amount of metal component. Thus, the sensor 1020 may sense a density change of a metal component as the carrier or the transporting member passes in a specific volume. As the transporting member including a metal component rotates, the sensor 1020 may sense movement of the transporting member each time when the transporting member passes around the sensor 1020. That is, the sensor 1020 may obtain an output signal in which a density change of a metal component corresponding to rotation of the transporting member is sensed. The sensor 1020 may calculate a residual amount of toner remaining in the toner cartridge 1010, based on the sensed density change of the carrier within a range sensible by the sensor 1020. The remaining amount of toner in the toner cartridge 1010 may be calculated by the processor 1060.

The developing device 1030 may perform an image forming job as the toner is supplied from the toner cartridge 1010. The processor 1060 may control the toner cartridge 1010 and the developing device 1030 to supply the toner in the toner cartridge 1010 to the developing device 1030.

The user interface device 1040 may include an input unit for receiving an input for controlling an operation of the image forming apparatus 10 from the user, or the like, and an output unit for displaying information such as a result of performing the operation of the image forming apparatus 10, a state of the image forming apparatus 10, or the like. For example, the user interface device 1040 may include an operation panel that receives a user input, a display panel that displays a screen, and so forth.

As an example, the input unit may include various forms of devices capable of receiving a user input, such as a keyboard, a physical button, a touch screen, a camera, a microphone, etc. The output unit may include the display panel, the speaker, etc. However, the user interface device 1040 may also include various devices that support input and output, without being limited to the foregoing examples.

The memory 1050 may store a program, data, or a file related with the image forming apparatus 10. The processor 1060 may execute a program stored in the memory 1050, read data or a file stored in the memory 1050, or store a new file in the memory 1050. The memory 1050 may store a program command, a data file, a data structure, and the like solely or in a combined manner. The memory 1050 may store instructions executable by the processor 1060.

The processor 1060 may control an operation of the image forming apparatus 10 and may include at least one processor such as a central processing unit (CPU), or the like. The processor 1060 may include at least one specialized processor corresponding to each unit or may be a processor in an integral form.

The sensor 1020 may obtain an output signal corresponding to the degree of shrinkage of the transporting member as the transporting member rotates and may deliver the obtained output signal to the processor 1060 of the image forming apparatus 10.

The processor 1060 may determine the state of the toner cartridge 1010 based on a characteristic of the output signal. For example, the characteristic of the output signal may include at least one of a periodicity of the output signal or a sensing signal sensed by a sensor when a transporting member passes within a range sensible by the sensor.

For example, the processor 1060 may determine the state of the toner cartridge 1010 based on whether the periodicity of the output signal is detected from the output signal.

As an example, when an amplitude indicating a difference between a maximum value and a minimum value in a specific period of the output signal is less than a reference amplitude, the processor 1060 may determine that the periodicity of the output signal is absent and determine the state of the toner cartridge 1010 as the abnormal state. The processor 1060 may determine the state of the toner cartridge 1010, based on Equation (1) and Equation (2).

For example, the processor 1060 may determine the state of the toner cartridge 1010, based on a result of comparing a sensing signal in the output signal with a reference sensing signal in a reference output signal. Herein, the sensing signal is a signal sensed by the transporting member in the sensor 1020 as the transporting member rotates. The reference output signal is a signal obtained by the sensor 1020 when the toner cartridge 1010 is in the normal state. The reference sensing signal is a signal sensed by the transporting member in the sensor 1020 as the transporting member rotates, when the toner cartridge 1010 is in the normal state. For example, the normal state of the toner cartridge 1010 may refer to a state in which the toner cartridge 1010 may normally supply toner to a developing device 1030.

As an example, the processor 1060 may obtain the number of sensing signals in an output signal and the number of reference sensing signals in a reference output signal, in which the sensing signals and the reference sensing signals are sampled at specific intervals. When a difference between the number of sensing signals and the number of reference sensing signals falls beyond a preset error range, the processor 1060 may determine the state of the toner cartridge 1010 as the abnormal state. For example, the processor 1060 may determine the state of the toner cartridge 1010, based on Equation (5) and Equation (6). The processor 1060 may determine the state of the toner cartridge 1010, based on Equation (7).

When the processor 1060 determines that the state of the toner cartridge 1010 is the abnormal state in which the toner cartridge 1010 may not be able to normally supply the toner to the developing device 1030, the processor 1060 may execute a recovery mode to increase a driving force delivered to the transporting member.

As an example, the processor 1060 may determine that the distribution of the developing agent in the toner cartridge 1010 is not uniform and execute a recovery mode for spreading the developing agent in a region having a high density of the developing agent in a specific direction. The processor 1060 may rotate the transporting member while increasing a driving force delivered to the transporting member by increasing a current or RPM of the driving device. For example, the processor 1060 may rotate the transporting member twice while increasing a driving force delivered to the transporting member. Upon execution of the recovery mode, the density of the developing agent in the region having a high density of the developing agent may be reduced.

The recovery mode may be executed for the toner cartridge 1010, and the processor 1060 may determine whether the toner cartridge 1010 is recovered to the normal state.

For example, the processor 1060 may determine whether the state of the toner cartridge 1010 is recovered to the normal state, based on at least one of the first process of determining the state of the toner cartridge 1010 based on Equation (1) and Equation (2), the second process of determining the state of the toner cartridge 1010 based on Equation (5) and (6), and the third process of determining the state of the toner cartridge 1010 based on Equation (7).

When the state of the toner cartridge 1010 fails to be recovered to the normal state, the processor 1060 may determine an action for the toner cartridge 1010, based on the number of accumulated times the recovery mode is executed, and execute the determined action.

For example, when the number of accumulated times the recovery mode is executed is less than three, the processor 1060 may re-execute the recovery mode to increase a driving force delivered to the transporting member.

For example, when the number of accumulated times the recovery mode is executed is equal to or greater than three, the processor 1060 may determine that an action of shaking the toner cartridge 1010 is needed. The user interface device 1040 may display first guide information that guides removal of the toner cartridge 1010 from the image forming apparatus 10 and shaking of the toner cartridge 1010. A user may remove the toner cartridge 1010 from the image forming apparatus 10 and shake the toner cartridge 1010 to mix the developing agent in the toner cartridge 1010. The user may finish shaking the toner cartridge 1010 and mount the toner cartridge 1010 on the image forming apparatus 10. When the toner cartridge 1010 is mounted on the image forming apparatus 10, the processor 1060 may determine, based on an output signal obtained through the sensor 1020, that the state of the toner cartridge 1010 is recovered to the normal state.

For example, when the number of accumulated times the recovery mode is executed is equal to or greater than three and shaking of the toner cartridge 1010 has already been performed, the processor 1060 may determine that the toner cartridge 1010 leaves the driving device in the image forming apparatus 10 and needs to be replaced. The user interface device 1040 may display second guide information indicating that the toner cartridge 1010 leaves the image forming apparatus 10 and thus needs to be replaced. The user may replace the existing toner cartridge 1010 with the new toner cartridge 1010.

When the state of the toner cartridge 1010 is recovered to the normal state, the processor 1060 may determine that the state of the toner cartridge 1010 is the normal state and control operations of components of the toner cartridge 1010 to supply toner to the developing device 1030 from the toner cartridge 1010.

The processor 1060 may determine an exterior state of the transporting member, based on a characteristic of the output signal. Herein, a characteristic of the output signal may include at least one of a periodicity of the output signal or a sensing signal sensed by a sensor when a transporting member passes within a range sensible by the sensor. For example, when the processor 1060 determines that the exterior state of the transporting member is a specific state, the processor 1060 may determine that the state of the toner cartridge 1010 is the abnormal state. For example, the specific state may include at least one of a state in which the transporting member shrinks due to imbalance of the distribution of the toner in the toner cartridge 1010, as compared to the transporting member in the normal state of the toner cartridge 1010, or a state in which the transporting member leaves the driving device of the image forming apparatus 10.

Example methods as described above may be implemented in the form of a non-transitory computer-readable storage medium having stored therein instructions or data executable by a computer or a processor. The foregoing disclosure may also be written as programs executable on computers, and may be implemented on general-purpose digital computers operating the programs by using non-transitory computer-readable storage media. Examples of the non-transitory computer-readable storage media may include read-only memory (ROM), random-access memory (RAM), flash memory, compact disc (CD)-ROMs, CD-recordables (CD-Rs), CD+Rs, CD-rewritables (RWs), CD+RWs, digital versatile disc (DVD)-ROMs, DVD-Rs, DVD+Rs, DVD-RWs, DVD+RAMs, Blue-ray (BD)-ROMs, BD-recordables (Rs), BD-R low-to-high (LTHs), BD-rewritables (REs), magnetic tapes, floppy disks, magneto-optical data storage devices, optical data storage devices, hard disks, solid state disks (SSDs), and any device capable of storing instructions or software, related data, data files, and data structures, and providing the instructions or the software, the related data, the data files, and the data structures to a processor or a computer to enable the processor or the computer to execute the instructions.

It should be understood that examples described herein should be considered in a descriptive sense only and not for purposes of limitation. Descriptions of features or aspects within each example should typically be considered as available for other similar features or aspects in other examples. While one or more examples have been described with reference to the figures, it will be understood by those of ordinary skill in the art that various changes in form and details may be made therein without departing from the spirit and scope as defined by the following claims.

What is claimed is:

1. An operation method of an image forming apparatus, the operation method comprising:

obtaining, from a sensor, an output signal corresponding to a degree of shrinkage of a transporting member that transports a developing agent in a toner cartridge, as the transporting member rotates;

determining a state of the toner cartridge based on a characteristic of the output signal; and executing a recovery mode that increases a driving force delivered to the transporting member when determining that the state of the toner cartridge is an abnormal state in which toner is not normally supplied to a developing device.

2. The operation method of claim 1, wherein the obtaining of the output signal through the sensor comprises obtaining the output signal in which a density change of a metal component is sensed with respect to rotation of the transporting member within a range sensible by the sensor.

3. The operation method of claim 1, wherein the characteristic of the output signal comprises at least one of a periodicity of the output signal or a sensing signal sensed by the sensor when the transporting member passes within a range sensible by the sensor.

4. The operation method of claim 3, wherein the determining of the state of the toner cartridge comprises at least one of:

determining the state of the toner cartridge based on whether the periodicity of the output signal is detected from the output signal; or determining the state of the toner cartridge based on a result of comparing the sensing signal in the output signal with a reference sensing signal obtained in a normal state of the toner cartridge.

5. The operation method of claim 4, wherein the determining of the state of the toner cartridge based on whether the periodicity of the output signal is detected from the output signal comprises determining that the periodicity of the output signal is absent and determining the state of the toner cartridge as the abnormal state, when an amplitude indicating a difference between a maximum value and a minimum value in a specific period of the output signal is less than a reference amplitude.

6. The operation method of claim 4, wherein the determining of the state of the toner cartridge based on the result of comparing the sensing signal with the reference sensing signal comprises determining that the state of the toner cartridge is the abnormal state when a difference between a number of sensing signals in the output signal, sampled in specific periods, and a number of reference sensing signals, sampled in the specific periods, falls beyond a preset error range.

7. The operation method of claim 1, further comprising:

determining whether the state of the toner cartridge is recovered to a normal state, based on an output signal obtained through the sensor, after the executing of the recovery mode; and displaying a result of determining the state of the toner cartridge.

8. The operation method of claim 7, further comprising:

determining an action for the toner cartridge based on a number of accumulated times the recovery mode is executed; and executing the action when determining that the state of the toner cartridge fails to be recovered to the normal state and is the abnormal state.

9. The operation method of claim 8, further comprising displaying guide information guiding execution of the action, wherein the guide information comprises at least one of:

first guide information guiding removal of the toner cartridge from the image forming apparatus and shaking of the toner cartridge; or second guide information indicating that replacement of the toner cartridge is needed.

10. The operation method of claim 1, further comprising:

determining an exterior state of the transporting member based on characteristics of the output signal; and determining that the state of the toner cartridge is the abnormal state when determining that the exterior state of the transporting member is a specific state.

11. A non-transitory computer-readable storage medium having stored therein instructions executable by a processor, the instructions comprising:

instructions for obtaining, from a sensor, an output signal corresponding to a degree of shrinkage of a transporting member that transports a developing agent in a toner cartridge, as the transporting member rotates;

instructions for determining a state of the toner cartridge based on a characteristic of the output signal; and instructions for executing a recovery mode that increases a driving force delivered to the transporting member when it is determined that the state of the toner cartridge is an abnormal state in which toner is not normally supplied to a developing device.

12. An image forming apparatus comprising:

a toner cartridge;

a sensor to obtain an output signal corresponding to a degree of shrinkage of a transporting member that transports a developing agent in the toner cartridge as the transporting member rotates;

a developing device supplied with toner in the developing agent from the toner cartridge;

a user interface device;

a processor; and a memory storing instructions executable by the processor, wherein the processor executes the instructions to:

determine a state of the toner cartridge based on a characteristic of the output signal; and execute a recovery mode that increases a driving force delivered to the transporting member when determining that the state of the toner cartridge is an abnormal state in which toner is not normally supplied to the developing device.

13. The image forming apparatus of claim 12, wherein the sensor is arranged near a toner outlet in the toner cartridge when the toner cartridge is mounted in the image forming apparatus, and wherein the sensor obtains the output signal in which a density change of a metal component is sensed with respect to rotation of the transporting member within a range sensible by the sensor.

14. The image forming apparatus of claim 12, wherein the characteristic of the output signal comprises at least one of a periodicity of the output signal or a sensing signal sensed by the sensor when the transporting member passes within a range sensible by the sensor, and wherein the processor further executes the instructions to:

determine the state of the toner cartridge based on whether the periodicity of the output signal is detected from the output signal; or determine the state of the toner cartridge based on a result of the sensing signal in the output signal with a reference sensing signal obtained in a normal state of the toner cartridge.

15. The image forming apparatus of claim 12, wherein the processor further executes the instructions to:

determine whether the state of the toner cartridge is recovered to a normal state, based on an output signal obtained through the sensor, after the execution of the recovery mode;

determine an action for the toner cartridge based on a number of accumulated times the recovery mode is executed, when determining that the state of the toner cartridge fails to be recovered to the normal state and is the abnormal state; and display guide information guiding execution of the action through the user interface device.

* * * * *